US006499614B1

(12) United States Patent
Thompson

(10) Patent No.: US 6,499,614 B1
(45) Date of Patent: Dec. 31, 2002

(54) STRAW ACCESSIBLE COMPARTMENTED CONTAINER

(76) Inventor: Garey Thompson, P.O. Box 231167, Hartford, CT (US) 06123

( * ) Notice: Subject to any disclaimer, the term of this patent is extended or adjusted under 35 U.S.C. 154(b) by 0 days.

(21) Appl. No.: 10/185,316

(22) Filed: Jul. 1, 2002

Related U.S. Application Data

(62) Division of application No. 09/933,703, filed on Aug. 22, 2001, now Pat. No. 6,450,351.

(51) Int. Cl.[7] ..... B65D 25/04
(52) U.S. Cl. ..... 215/6; 215/388; 220/710
(58) Field of Search ..... 220/524, 507, 220/705, 708, 710; 215/388, 229, 6, 232

(56) References Cited

U.S. PATENT DOCUMENTS 3,705,661 A * 12/1972 Davis ..... 215/12.1
4,886,176 A * 12/1989 Steakley ..... 16/111.1
5,282,541 A * 2/1994 Chen ..... 215/12.1
5,819,972 A * 10/1998 Puente Pubill ..... 220/255
6,431,434 B1 * 8/2002 Haughton et al. ..... 220/708
6,450,351 B1 * 9/2002 Thompson ..... 215/6

* cited by examiner

*Primary Examiner*—Stephen Castellano
(74) *Attorney, Agent, or Firm*—Barbara R. Greenberg

(57) ABSTRACT

A straw accessible compartmented container is provided which consists of a beverage container having a plurality of compartments, each outer compartment individually accessed by drinking straws contained within concave bowl shaped depressions located in container shoulder portions. The bowl shaped depressions have centrally located apertures to receive the drinking straws. The drinking straws have corrugated middle portions that are located adjacent to and are larger in diameter than the apertures so that the drinking straws are anchored within the bowl shaped depressions and can pop outward when a depression covering cap is opened.

18 Claims, 4 Drawing Sheets

STRAW ACCESSIBLE COMPARTMENTED CONTAINER

This application is a divisional application and continuation-in-part of U.S. patent Application Ser. No. 09/933,703 filed Aug. 22, 2001 now U.S. Pat. No. 6,450,351

Background of the Invention

1. Field of the Invention

This invention relates to beverage containers having internal drinking straw access, mainly, a compartmented beverage container having individual compartment drinking straw means so that more than one user can drink from the same container in a convenient, clean and sanitary manner. In addition, this straw accessible compartmented beverage container can provide small quantities of different beverages, each beverage to be consumed at the desire of the user. Each beverage can remain pressurized and sanitary until accessed by drinking straw means.

2. Prior Art

Currently, a combination comprising a beverage container equipped to hold more than one beverage with each beverage having individual drinking straw access does not exist. Various designs have been proposed in the prior art for straw equipped beverage containers. U.S. Pat. No. 4,448,316 granted to Hiroshige, describes a single compartment liquid container with a spring activated straw designed to pop out of a container mouth when a container seal is removed. The present invention has no spring requirement. U.S. Pat. No. 5,172,827 discloses a single compartment beverage container with a rotatable tab designed to pull up and release a drinking straw. There is no rotatable tab in the present invention. U.S. Pat. No. 5,848,721 granted to Cornell, et at, describes a two straw equipped single compartment beverage container. In this case, a straw dispensing mechanism employs a float. U.S. Pat. No. 6,010,034 granted to Walthers discloses a combination outer drink container designed to deliver a drink by straw means and an inner sports spray bottle container designed to spray a cooling liquid. While a dual chambered container is disclosed, each chamber has an entirely separate structure and function. None of the references cited above suggest or teach a compartmented container holding distinctive beverages, each beverage having easily accessed drinking straw means.

The present invention addresses a need for a multi liquid container where each liquid can be separately, sanitarily and safely accessed by drinking straw means. At present, one, two and three liter beverage containers contain one liquid each. They are not compartmented. Once opened, if pressurized, the liquid can lose carbonation and become stale. Also, these one, two and three liter beverage containers have single openings without self contained straw access means. If more than one user drinks directly from the container, disease organism transmission is a threat.

A primary objective of the present invention is to provide a single container having a plurality of beverage containing compartments, each compartment having an independent means for quick drinking straw beverage delivery.

Another primary objective of the present invention is to provide a means for sanitary and safe beverage drinking from one container by two or more individuals.

Another objective of the present invention is to provide a compartmented container having separate compartment drinking straws wherein the drinking straws come in a variety of sizes.

Still another objective of the present invention is to provide a compartment container having separate drinking straw means for each compartment so that a beverage can be consumed from one compartment while another or the same beverage remains pressurized and sealed in another compartment.

Another objective of the present invention is to provide an attractive, convenient easily handled container for sanitary drinking by more than one individual.

The foregoing objectives and advantages are achieved by the present invention comprising a multi compartmented container as described in patent Application Ser. No. 09/933,703, incorporated herein by reference. In the present invention, each compartment has a shoulder located concave depression and each depression houses a compressed partially corrugated straw held in place by hinged cap means. Upon cap opening and straw release, the corrugated straw springs forth to enable a user to enjoy a beverage contained within the compartment. A straw access assembly is provided for each outer container compartment. If a drinking straw is damaged, easy one step replacement is possible. Drinking straws can vary in size depending on the thickness of a beverage within a compartment.

The above mentioned objectives and features of the present invention along with novel features that characterize the present invention will become apparent and better understood by those skilled in the art from the subsequent description, appended claims and accompanying drawings in which are illustrated the preferred embodiment of the invention.

DETAILED DESCRIPTION OF THE INVENTION

Figure 1:
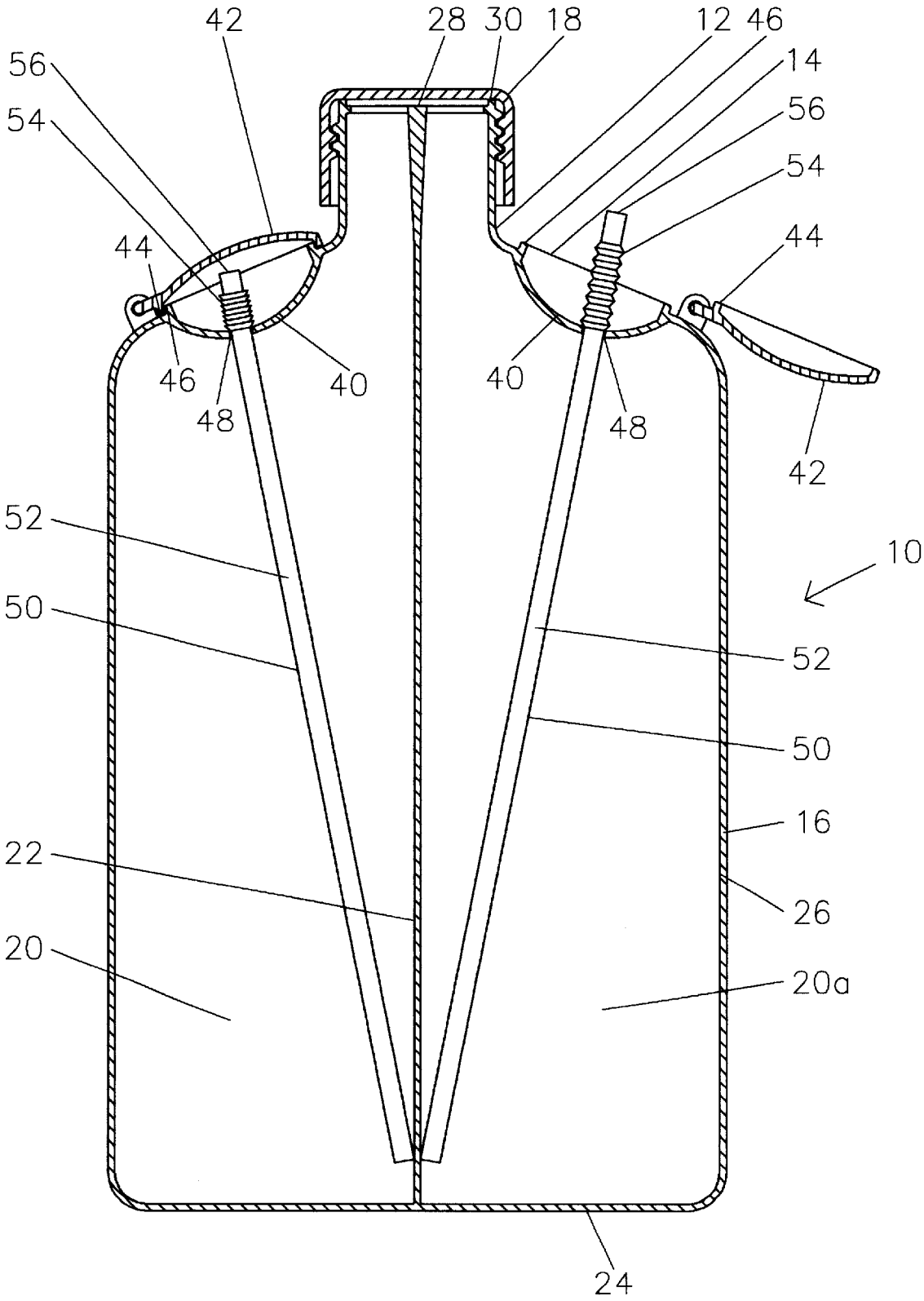
FIG. 1 is a cross sectional elevational view of a straw accessible compartmented container showing an enclosed drinking straw and an unenclosed drinking straw.
Figure 2:
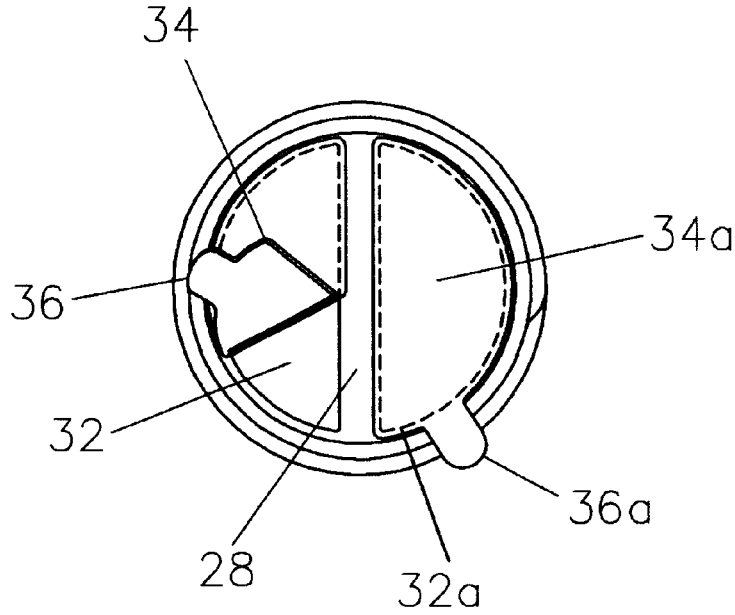
FIG. 2 is a top view of a neck portion of a straw accessible compartmented container.
Figure 3:
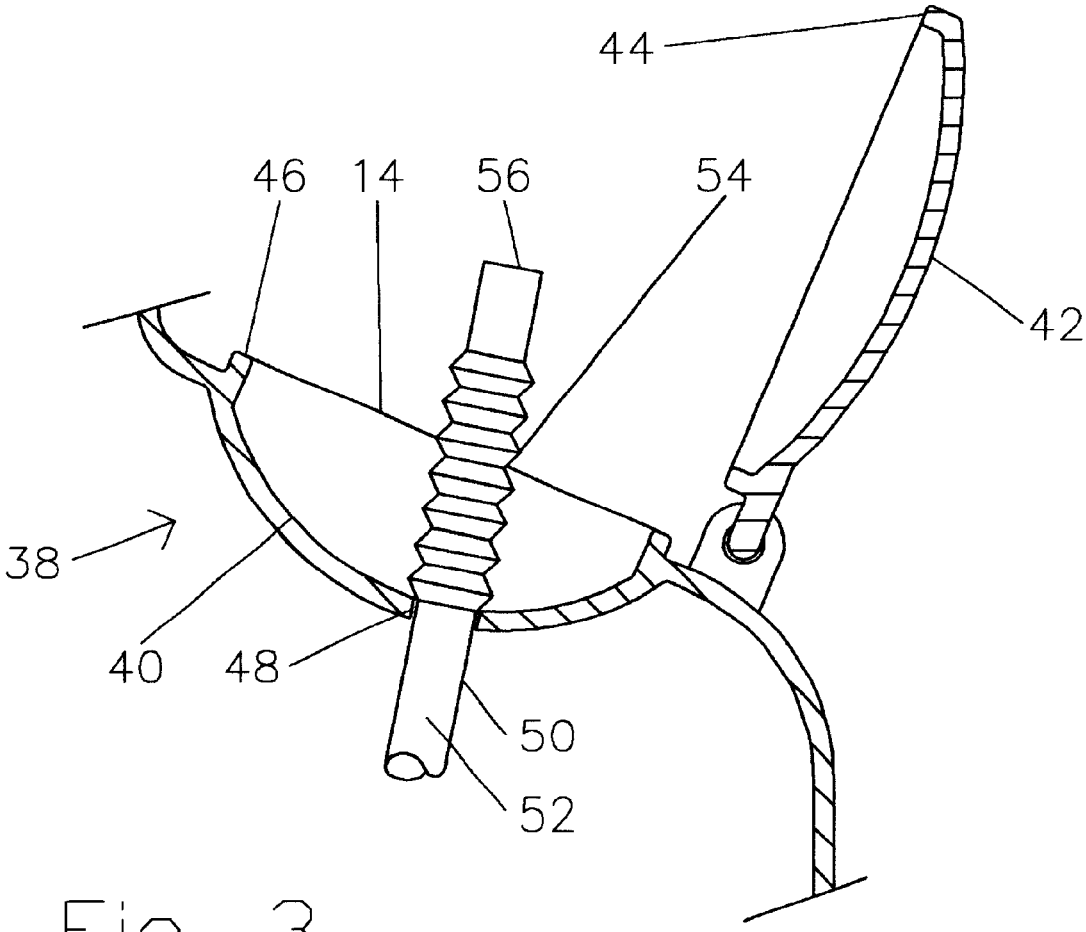
FIG. 3 is a cross sectional view of a straw accessible compartment container and straw accessible multi compartmented container drinking straw assembly.

Referring now to the drawings, in FIG. 1, a cross sectional view of a straw accessible compartmented container 10 is depicted including a neck portion 12, a shoulder portion 14 and a body portion 16. The neck portion 12 retains a cap 18 by screw means. The cap 18 can also be snapped on to neck portion 12. The body portion 16 is divided into a plurality of compartments, 20, 20*a*, by a dividing wall 22 that extends substantially in a longitudinal direction in the body portion 16 as a vertical extension of a bottom wall 24 which is contiguous with a side wall 26. The dividing wall 22 is thicker at a top surface 28 than at the bottom wall 24. The top surface along with a neck wall 30 top surface define semi circular openings 32, 32*a* as illustrated in FIG. 2. Each opening is covered by larger than opening, flexible, foil seals 34, 34*a* with tabs 36, 36*a*. The seals 34, 34*a* enclose compartments 20, 20*a* so that any beverages contained in compartments 20, 20*a* remain fresh and pressurized until a seal 34, 34*a* is removed. In addition, a plurality of drinking straw assemblies 38 as depicted in FIG. 1 and detailed in FIG. 3 not only provide additional means for maintaining beverage freshness and pressure but also furnish an added access to contained beverages. The drinking straw assembly 38 is comprised of a concave bowl shaped depression 40 located within the straw accessible compartmented container 10 shoulder portions 14, each compartment 20, 20*a* having an associated shoulder portion 14. The concave bowl shaped depression 40 is closed and opened with a cover 42 preferably hinged to prevent cover 42 loss and for easy opening and closing, the cover 42 shown in a closed position and also shown in an open position in FIG. 1. A snap on cover without a hinge can also be used. This cover 42 has a collar 44 that could snap on to an annular ring projection 46 located around a perimeter of the concave bowl shaped depression 40 or the cover 42 could have screw means to connect to shoulder portion 14 and cover the concave bowl shaped depression 40. Concave bowl shaped depression 40 has a centrally located aperture 48 sized to fit a drinking straw 50 so that there is a snug fit when a drinking straw 50 distal portion 52 is slipped through aperture 48 and immersed into a beverage contained in a straw accessible compartmented container 10 compartment 20, 20*a*. However, the snug fit is such that a damaged drinking straw 50 can easily be replaced. The drinking straw 50 has a corrugated portion 54 below an open proximal end 56 for user beverage access. With a plurality of drinking straw assemblies 38, more than one user can simultaneously and sanitarily drink separated beverages from the same container. The corrugated portion 54 is located in the concave bowl shaped depression 40 adjacent to and larger in diameter than aperture 48 and, therefore cannot slip through aperture 48. The corrugated portion 54 anchors drinking straw 50 to the bowl shaped depression'out wall 58. Aperture 48 can vary in diameter allowing for a variance in diameter for the drinking straw 50 distal portion 52. A large diameter aperture 48 and drinking straw 50 distal end portion 52 can be used for thick liquids and a smaller diameter aperture 48 and distal portion 52 can be used for thin liquids. The drinking straw 50 proximal end portion 56 diameter can be adjusted to coincide with the distal end portion 56 diameter. Since each straw accessible compartmented container 10 is fitted with more than one drinking straw assembly 38, the drinking straw assembly 38 can have drinking straws 50 and apertures 48 all of the same diameter or of different diameters depending on the beverages contained therein.

As show in FIG. 1, when the concave bowl shaped depression 40 is sealed by cover 42, the corrugated portion 50 is compressed within the concave bowl shaped depression 40. On the other hand, when the concave bowl shaped depression 40 is not covered, the corrugated portion 50 is expanded and urged outward readying the drinking straw 50 open proximal end 56 for a user'mouth acceptance.

Figure 4:
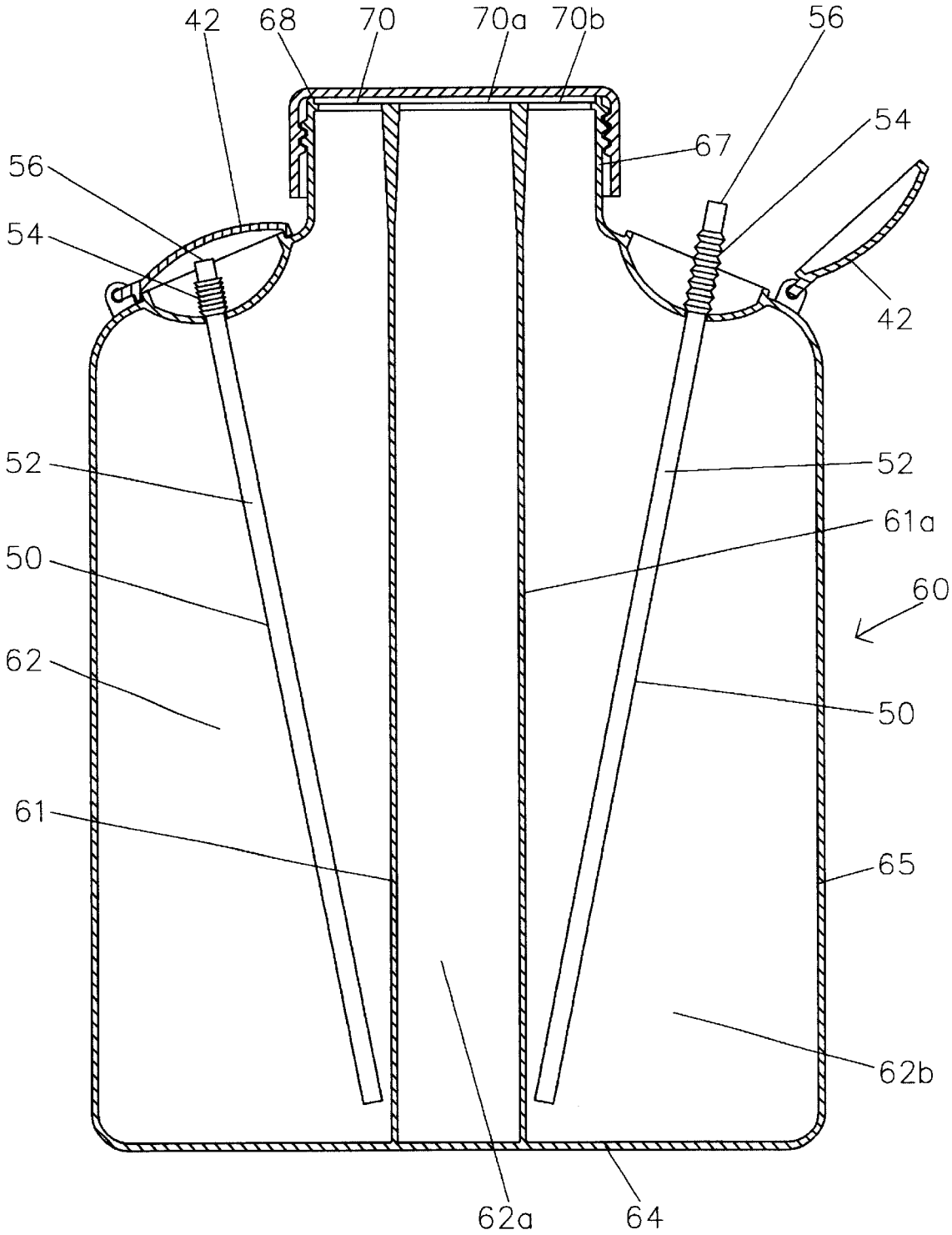
FIG. 4 is a cross sectional elevational view of a straw accessible multi compartmented container showing an enclosed drinking straw and an unenclosed drinking straw.

Another embodiment of the straw accessible compartmented container 10 is shown in FIG. 4. Here a straw accessible multi compartmented container 60 has a plurality of dividing walls, 61, 61*a* disposed to form compartments 62, 62*a*, 62*b*. Dividing walls 61, 61*a* can be an extension of bottom wall 64 and are substantially parallel, extending in a longitudinal direction. Dividing walls 61, 61*a* are attached to or can be molded from side wall 65, shoulder walls 66, 66*a* and neck wall 67 to terminate at a height equal to the neck wall 67 top surface 68. The dividing walls 61, 61*a* are thicker at the straw accessible multi compartmented container neck wall 67 top surface 68 than at the bottom wall 64. The thickened portions top surfaces and the neck wall 67 top surface 68 defining openings 70, 70*a*, 70*b*, each opening separately sealed with a flexible, foil cover, each cover having a tab for easy opening. A plurality of drinking straw assemblies 38 as described herein reside within the straw accessible multi compartmented container 60 shoulder walls 66, 66*a*. Access to beverages contained with the straw accessible multi compartmented container 60 outer compartments 62, 62*b* can be achieved through openings 70, 70*b* by removing each flexible foil cover covering openings 70, 70*b* or through the drinking straw assemblies 38 drinking straws 50. Access to beverage contained within inner compartment 62*a* is achieved through opening 70*a* when the associated flexible foil is removed. In this embodiment, more than two users can drink beverages from the multi compartmented container, each outer compartment 62, 62*b* user having separate sanitary drinking straw access to a separate beverage.

Figure 5:
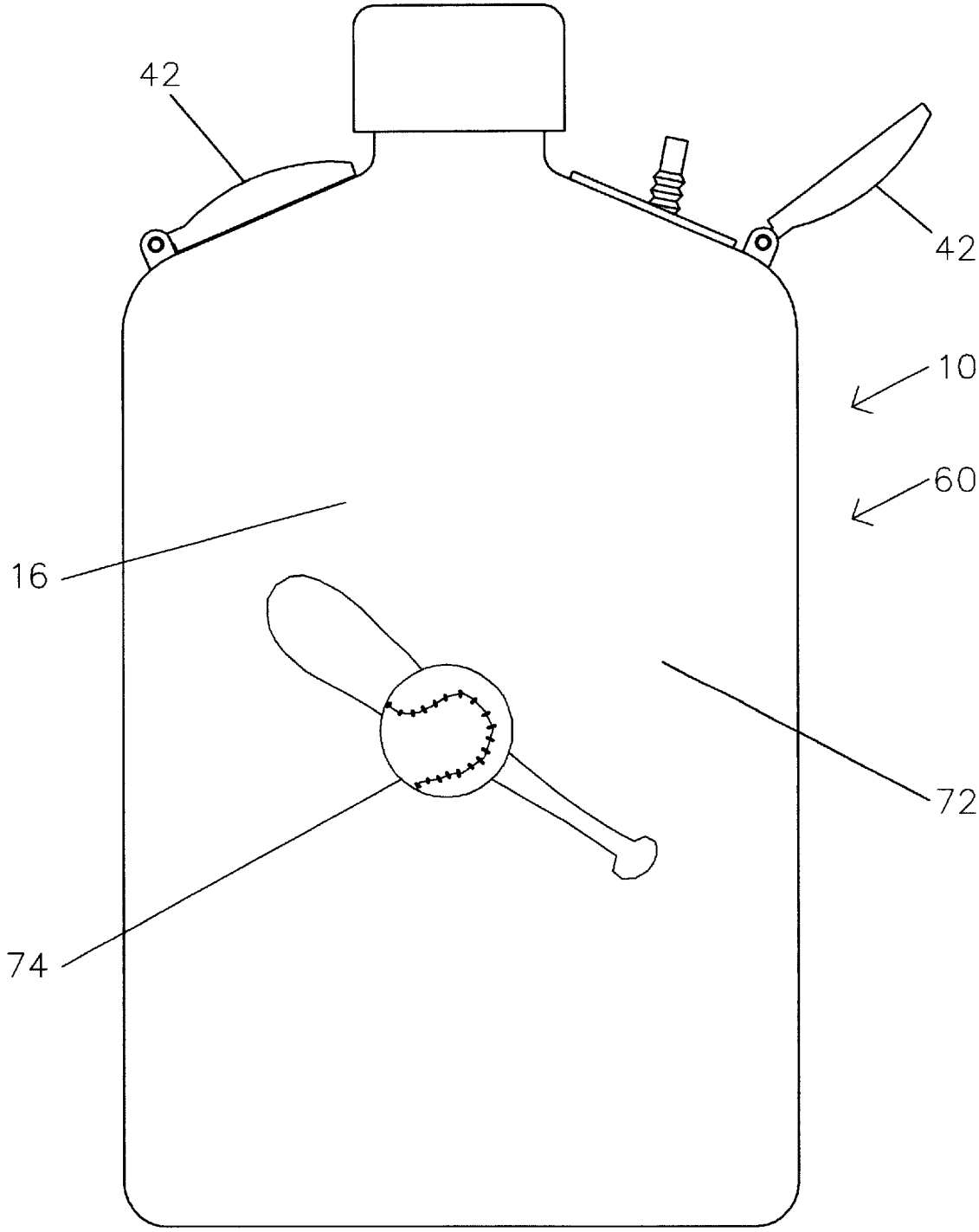
FIG. 5 is a front view of a straw accessible compartmented container and a straw accessible multi compartmented container showing a sports graphic on the container front wall.

FIG. 5 shows the straw accessible compartmented container 10 or the straw accessible multi compartmented container 60 with body portions 16 or 72, respectively, having a sports motif illustration 74 that can be a surface illustration or embossed on the body portion 16 or 72. The sports motif can be baseball, golf, football, soccer, tennis, volleyball or any other sporting event where participants and onlookers desire to drink liquid beverages. The sports motif illustration 74 can be colored and use symbols to identify a certain sport. In addition, a generic illustration and generic symbols can be placed on the straw accessible compartmented container 10 or the straw accessible multi compartmented container 60 front body portion 16 or 72, respectively.

It is to be understood that the present invention is not limited to illustrations and certain embodiments and versions described and shown herein, which are deemed to be merely illustrative of the best and preferred modes of carrying out the invention, and which are susceptible to other versions in regard to arrangement of parts, form, size and mode of operation. Therefore, the present invention is intended to encompass all such versions which are within its spirit and scope as defined by the appended claims.

What is claimed is:

1. A straw accessible compartmented container having a body portion partitioned into a plurality of compartments, said body portion having a plurality of shoulder portions, each compartment having an associated shoulder portion, said shoulder portions housing a plurality of drinking straw assemblies, each drinking straw assembly comprised of:

a concave bowl shaped depression, a cap to cover said depression, a centrally located aperture in said concave bowl shaped depression, and a drinking straw having an open proximal end and a distal portion separated by a corrugated portion, said corrugated portion being located in said concave bowl shaped depression adjacent to and larger in diameter than said aperture for drinking straw retention in said bowl shaped depression and said distal portion slipped through said aperture to reside in a beverage contained within said straw accessible compartmented container compartment.

2. The straw accessible compartmented container of claim 1 wherein said drinking straw assemblies have the same size apertures.

3. The straw accessible compartmented container of claim 1 wherein each drinking straw assembly has a different aperture size from another.

4. The straw accessible compartmented container of claim 1 wherein each drinking straw assembly is fitted with the same diameter drinking straws.

5. The straw accessible compartmented container of claim 1 wherein each drinking straw assembly is fitted with a different diameter drinking straw.

6. The straw accessible compartmented container of claim 1 wherein said cap is connected to said body portion by a hinge.

7. The straw accessible compartmented container of claim 1 wherein said cap is snapped onto a body portion annular ring.

8. The straw accessible compartmented container of claim 1 wherein said cap is secured to said body portion by screw means.

9. The straw accessible compartmented container of claim 1 wherein said body portion displays a sports motif illustration.

10. A straw accessible multi compartmented container having a body portion partitioned into more than two compartments comprising two outer compartments and at least one inner compartment, said inner compartment having a neck wall top surface removable foil seal for beverage access and each outer compartment having an associated shoulder portion, each outer compartment shoulder portion housing a drinking straw assembly, each drinking straw assembly comprised of:

a concave bowl shaped depression, a cap to cover said depression, a centrally located aperture in said concave bowl shaped depression, and a drinking straw having an open proximal end and a distal portion separated by a corrugated portion, said corrugated portion being located in said concave bowl shaped depression adjacent to and larger in diameter than said aperture for drinking straw retention in said bowl shaped depression and said distal portion slipped through said aperture to reside in a beverage contained within said straw accessible compartmented container compartment.

11. The straw accessible multi compartmented container of claim 10 wherein said drinking straw assemblies have the same size apertures.

12. The straw accessible multi compartmented container of claim 10 wherein each drinking straw assembly has a different aperture size from another.

13. The straw accessible multi compartmented container of claim 10 wherein each drinking straw assembly is fitted with the same diameter drinking straws.

14. The straw accessible multi compartmented container of claim 10 wherein each drinking straw assembly is fitted with a different diameter drinking straw.

15. The straw accessible multi compartmented container of claim 10 wherein said cap is connected to said body portion by a hinge.

16. The straw accessible multi compartmented container of claim 10 wherein said cap is snapped onto a body portion annular ring.

17. The straw accessible multi compartmented container of claim 10 wherein said cap is secured to said body portion by screw means.

18. The straw accessible multi compartmented container of claim 10 wherein said body portion displays a sports motif illustration.

* * * * *